US010061269B2

(12) United States Patent
Graf et al.

(10) Patent No.: US 10,061,269 B2
(45) Date of Patent: Aug. 28, 2018

(54) BALANCE WHEEL-SPRING ASSEMBLY OF TIMEPIECE

(71) Applicant: Nivarox-FAR S.A., Le Locle (CH)

(72) Inventors: Emmanuel Graf, Le Locle (CH); Marc Stranczl, Nyon (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/505,270

(22) PCT Filed: Aug. 19, 2015

(86) PCT No.: PCT/EP2015/069085
§ 371 (c)(1),
(2) Date: Feb. 21, 2017

(87) PCT Pub. No.: WO2016/030257
PCT Pub. Date: Mar. 3, 2016

(65) Prior Publication Data

US 2017/0269552 A1 Sep. 21, 2017

(30) Foreign Application Priority Data

Aug. 29, 2014 (EP) ..... 14182777

(51) Int. Cl.
*G04B 18/00* (2006.01)
*G04B 18/06* (2006.01)

(52) U.S. Cl.
CPC ..... *G04B 18/006* (2013.01); *G04B 18/06* (2013.01)

(58) Field of Classification Search
CPC ..... G04B 17/063; G04B 17/20; G04B 17/22; G04B 18/00; G04B 17/24; G04B 18/006; G04B 18/06
(Continued)

(56) References Cited

U.S. PATENT DOCUMENTS 2,880,570 A 4/1959 Favret et al.
8,414,184 B2 * 4/2013 Mallet ..... G04B 18/006 368/127
(Continued)

FOREIGN PATENT DOCUMENTS

CH 705 238 A2 1/2013

OTHER PUBLICATIONS

International Search Report dated Nov. 6, 2015 in PCT/EP2015/069085 filed Aug. 19, 2015.

*Primary Examiner* — Edwin A. Leon
(74) *Attorney, Agent, or Firm* — Oblon, McClelland, Maier & Neustadt, L.L.P.

(57) ABSTRACT

A balance wheel-spring system including a balance wheel that oscillates about a balance wheel shaft and a spring, one inner spiral of which is fixed to the balance wheel shaft or to a collet mounted integrally with the shaft and one outer spiral of which is fixed to a stud integral with a bridge. The balance wheel includes a hub, a rim, an arm connecting the hub to the rim, a front face which includes a countersink and a rear face, the arm including a housing receiving and retaining a flyweight, and the spring being mounted opposite the front face of the balance wheel. The flyweight is mounted on the arm on the rear face of the balance wheel, the distance between the bottom of the countersink of the front face of the balance wheel and the spring is a predetermined interval between 0.05 mm and 1.50 mm.

8 Claims, 2 Drawing Sheets

(58) Field of Classification Search
USPC ..... 368/169, 127, 168, 170–178; 968/116
See application file for complete search history.

(56) References Cited

U.S. PATENT DOCUMENTS

| | | | | |
|---|---|---|---|---|
| 9,547,278 | B2 * | 1/2017 | Graf | G04B 17/063 |
| 9,804,568 | B2 * | 10/2017 | Paratte | G04B 18/02 |
| 2013/0188461 | A1 * | 7/2013 | Mallet | G04B 17/063<br>368/173 |

* cited by examiner

B-B

BALANCE WHEEL-SPRING ASSEMBLY OF TIMEPIECE

FIELD OF THE INVENTION

The invention relates to a balance wheel-spring assembly, the balance wheel of which has means for adjusting the inertia.

The invention relates likewise to a timepiece movement comprising such a system and also a timepiece equipped with such a movement.

BACKGROUND OF THE INVENTION

From patent CH 705 238, a clamped flyweight balance wheel which allows adjustment of the inertia and/or of the balance is known. The balance wheel has two arms, each comprising a housing for receiving and clamping in position a rod of a flyweight. As a function of the direction of assembly of the balance wheel in the movement, it is possible that access to the flyweights positioned on the countersunk side of the balance wheel is difficult, or even impossible, and therefore requires dismantling. Furthermore, in the case where the distance between the stud and the inner diameter of the rim is too small, the flyweights can strike the stud, therefore having a damaging effect on good operation of the balance wheel.

SUMMARY OF THE INVENTION

The object of the invention is in fact to remedy the various disadvantages of the known prior art.

More precisely, one object of the invention is to provide a balance wheel which makes it possible to obtain a compact timepiece movement.

Another object of the invention is to provide a balance wheel-spring system which allows simple access to the flyweights in order to adjust the inertia after being housed.

The invention likewise has the object, at least in one particular embodiment, of providing a balance wheel-spring system which is simple to implement and not very expensive.

These objects, and also others which will appear more clearly subsequently, are achieved according to the invention with the help of a balance wheel-spring system comprising at least one balance wheel which oscillates about a pivot axis via a balance wheel shaft mounted between a bottom plate and a bridge (9) and aligned on said pivot axis, and at least one spring, one inner spiral of which is fixed to said balance wheel shaft or to a collet which is mounted integrally with said balance wheel shaft and one outer spiral of which is fixed to a stud which is integral with the bridge bearing said shaft, said balance wheel comprising a balance wheel hub, a rim, at least one arm connecting said hub to said rim, a front face which has a countersink and a rear face, said at least one arm comprising a housing for receiving and retaining a flyweight comprising a head and a rod, and said spring being mounted opposite the front face of the balance wheel.

According to the invention, said flyweight is mounted on the side of the rear face of the balance wheel, on said at least one arm of said balance wheel, said head resting against the rear face of said balance wheel and said rod is flush with the bottom of the countersink, and in that the distance between the bottom of the countersink of the front face of the balance wheel and the spring is at a predetermined interval between 0.05 mm and 1.50 mm.

According to other advantageous variants of the invention:

- the value of the predetermined interval is between 0.10 mm and 0.70 mm;
- the rod rests in the housing;
- the head of the at least one flyweight comprises control means so as to adjust the at least one flyweight from the rear face of the balance wheel;
- the diameter of the rod of the at least one flyweight is at least equal to the width of the housing;
- the at least one arm, the rim and the hub form a monobloc element.

The invention also relates to a timepiece movement comprising an oscillating balance wheel-spring system according to the invention.

The invention relates likewise to a timepiece comprising a timepiece movement according to the invention.

Thus, the subject of the present invention, via its various functional and structural aspects described above, makes it possible to obtain a timepiece movement comprising a balance wheel-spring system, in which access to the means of adjusting the inertia is particularly simple.

BRIEF DESCRIPTION OF THE DRAWINGS

Other features and advantages of the invention will appear more clearly upon reading the following description of one particular embodiment of the invention, given by way of simple example which is illustrative and non-limiting, and of the annexed Figures, amongst which.

DETAILED DESCRIPTION OF PREFERRED EMBODIMENTS

A balance wheel-spring assembly according to one embodiment will now be described in the following with reference jointly to FIGS. 1*a*, 1*b* and 2.

The invention thus relates to a timepiece balance wheel-spring system, which is intended to be incorporated in an oscillating mechanism in the centre of a timepiece movement, and comprising at least one balance wheel 1 which oscillates about a pivot axis P via a balance wheel shaft 40 aligned on the axis P and at least one spring 2.

Figure 2:
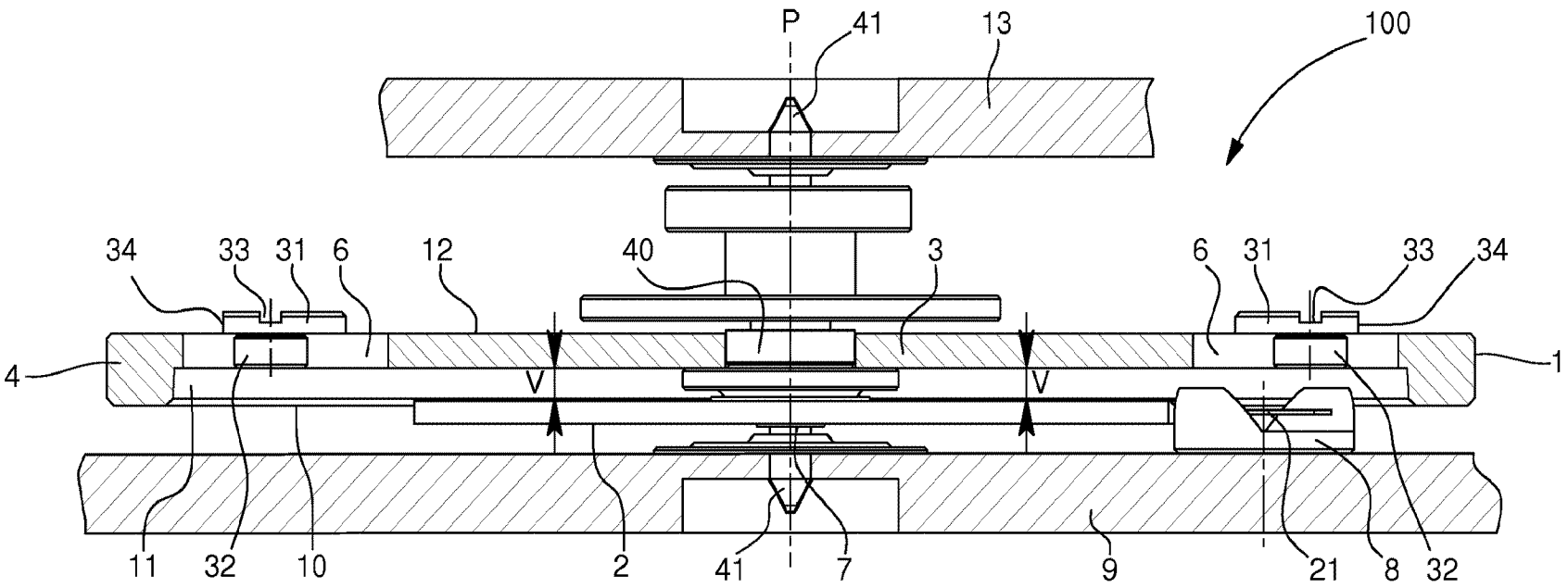
FIG. 2 is a sectional view according to the line A-A of FIG. 1 of a balance wheel-spring system according to the invention, which equips a timepiece movement.

As can be seen in FIG. 2, the balance wheel shaft 40 is mounted between a bottom plate 13 and a bridge 9, the balance wheel shaft 40 having, at each of its ends, a conical pivot 41 for allowing the balance wheel shaft 40 to pivot about the pivot axis P while limiting friction. An inner spiral (not visible in the Figures) of the spring 2 is fixed to the balance wheel shaft 40 or to a collet 7 which can be monobloc with the spring 2 which is mounted integrally with the balance wheel shaft 40 and an outer spiral 21 of the spring 2 is fixed to a stud 8 which is integral with a bridge 9.

The invention is described here in the particular case of a single balance wheel and single spring adjusting element, the person skilled in the art will be able to extrapolate the invention to the cases of a plurality of balance wheels and/or a plurality of springs.

As can be seen in the Figures, the balance wheel 1 comprises a hub 3 which bears the balance wheel shaft 40, a rim 4, at least one arm 5 connecting the hub 3 to the rim 4, a front face 10 which has a countersink 11 and a planar rear face 12 which can also be countersunk. The arm 5 comprises a housing 6 for receiving and retaining at least one flyweight 30, and the spring 2 is mounted opposite the front face 10 of the balance wheel 1 which receives the countersink 11.

Figure 1A:
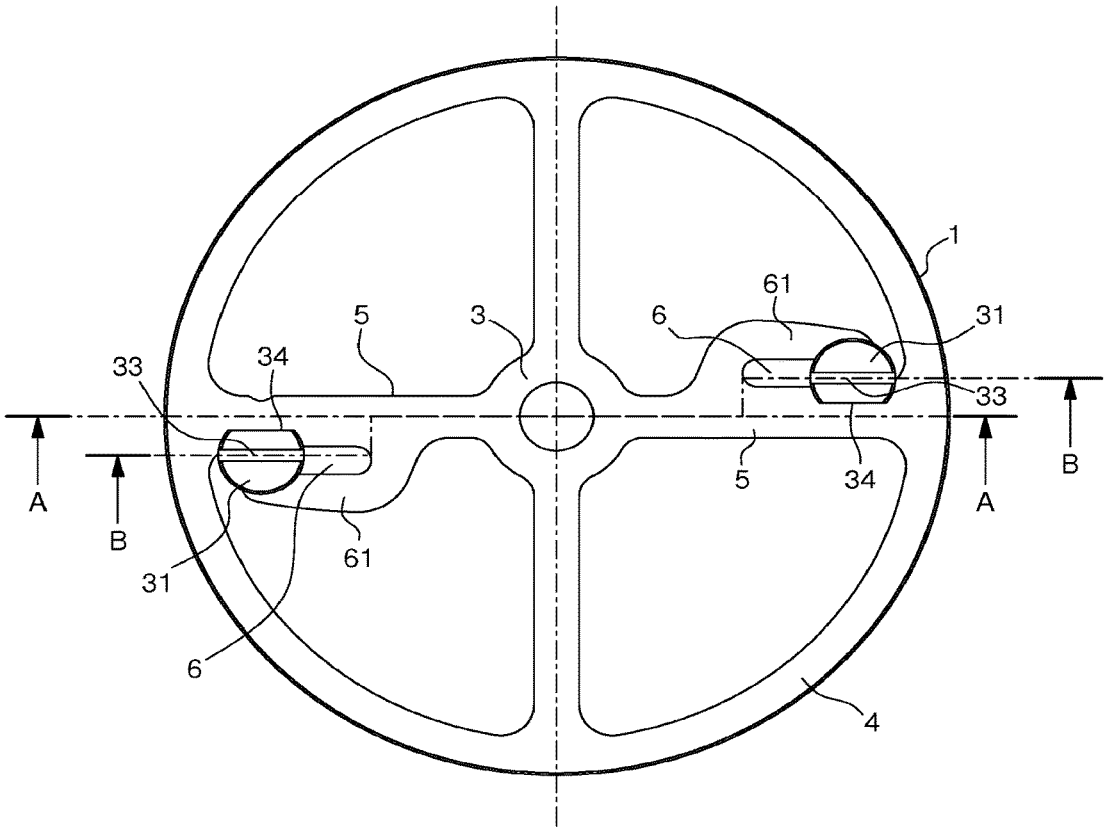
FIG. 1*a* is a view from below of a balance wheel according to the invention.
Figure 1B:
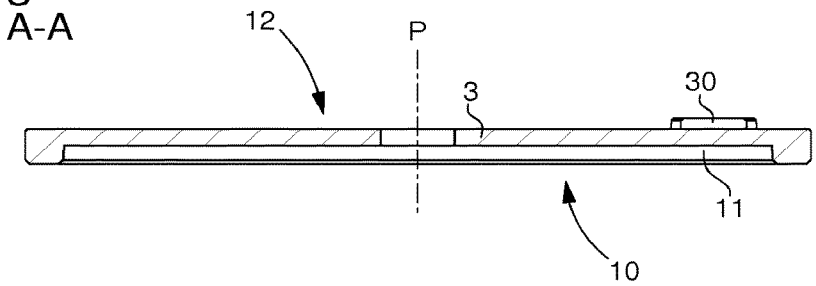
FIG. 1*b* is a sectional view according to the line A-A of FIG. 1 of a balance wheel according to the invention.

As can be seen in FIGS. 1*a* and 1*b*, the balance wheel 1 comprises rigid parts formed by the hub 3, the rim 4, and the arm 5 connecting the rim 4 to the hub 2. The housing 6 is delimited, on one hand by a rigid part of the balance wheel 1, and on the other hand by an elastically deformable portion 61.

The arm 5 comprises a housing 6 for receiving and clamping in position a rod 32 of a flyweight 30. This flyweight 30 comprises a head 31 which has control means, such as an adjustment profile 33 provided for cooperating with a tool, such as a screwdriver. Thus, the flyweight 30 can be adjusted from said rear face 12 of the balance wheel 1. The rod 32 of the flyweight 30 extends the head 31, which is of a greater diameter than that of the rod 32.

The diameter of the rod 32 of the flyweight 30 is chosen to be of a greater width than the housing 6 so that the rod 32 is retained by the elastically deformable portion 61, the portion 61 exerting a restoring force.

Advantageously, the length of the rod 32 does not exceed the thickness of the arm 5 such that the rod 32 does not project and thus optimises the arrangement of the parts in the centre of the movement in order to gain in compactness.

This simple configuration of a flyweight 30 formed solely by the head 31 and the rod 32 is favourable for assembly of the flyweight on the balance wheel 1 from the bottom of the latter.

The flyweight 30, once clamped in the housing 6, can be orientated angularly via the bias of a tool without being impeded by the spring 2 or by the little available space. The flyweight 30 comprises an unbalance produced by means of a flattened portion 34 provided on the head 31, as can be seen in FIG. 1*a*, in order to allow adjustment of the inertia of the balance wheel 1.

According to the invention, the flyweight 30 is mounted on the side of the rear face 12 of the balance wheel 1, the head 31 resting against the rear face 12 of the balance wheel 1 below the arm 5, the distance between the bottom of the countersink of the front face 10 of the balance wheel 1 and the spring 2 is at a predetermined interval V between 0.05 mm and 1.50 mm. In a more preferred manner, the predetermined interval V is between 0.10 mm and 0.70 mm. Such an arrangement makes it possible to obtain a compact arrangement and thus to reduce the bulkiness of the timepiece movement.

Particularly advantageously, the rod 32 is flush with the bottom of the countersink 11 of the front face 10 of the balance wheel 1 such that the countersink 11 has no projecting element, the stud 8 therefore being able to be provided nearest the rim 4, the stud 8 even being able to be situated nearest the bottom of the countersink 11.

The arm 5, the rim 4 and the hub 3 form the same monobloc element, the balance wheel 1 being able to be produced in a metallic material.

The invention likewise relates to a timepiece movement and a timepiece which are equipped with a balance wheel-spring system according to the invention.

Thanks to these various aspects of the invention, a compact balance wheel-spring system is available, which makes it possible to reduce the thickness of the timepiece movement and implicitly the thickness of the watch case so as to provide a relatively slim watch.

Of course, the present invention is not limited to the illustrated example and can have various variants and modifications which will be apparent to the person skilled in the art.

PARTS LIST

1. Balance wheel
2. Spring
21. Outer spiral
3. Hub
4. Rim
5. Arm
6. Housing
61. Elastic portion
7. Collet
8. Stud
9. Bridge
10. Front face
11. Countersink
12. Rear face
13. Bottom plate
30. Flyweight
31. Head
32. Rod
33. Adjustment profile
34. Flattened portion
40. Balance wheel shaft
41 Pivot
P. Pivot axis
V. Predetermined value

The invention claimed is:

1. A balance wheel-spring system comprising:

at least one balance wheel which oscillates about a pivot axis via a balance wheel shaft mounted between a bottom plate and a bridge and aligned on the pivot axis; and at least one spring, one inner spiral of which is fixed to the balance wheel shaft or to a collet mounted integrally with the balance wheel shaft and one outer spiral of which is fixed to a stud integral with the bridge bearing the balance wheel shaft;

the balance wheel comprising a balance wheel hub, a rim, at least one arm connecting the hub to the rim, a front face of which includes a countersink and a rear face, the at least one arm comprising a housing for receiving and retaining at least one flyweight comprising a head and a rod, and the spring being mounted opposite the front face of the balance wheel, wherein the at least one flyweight is mounted on the rear face of the balance wheel, on the at least one arm of the balance wheel, wherein the head resting against the rear face of the balance wheel and the rod is flush with a bottom of the countersink, and wherein a distance between the bottom of the countersink of the front face of the balance wheel and the spring is at a predetermined interval between 0.05 mm and 1.50 mm.

2. A system according to claim 1, wherein the predetermined interval is between 0.10 mm and 0.70 mm.

3. A system according to claim 1, wherein the rod rests in the housing.

4. A system according to claim 1, wherein the head of the at least one flyweight comprises control means to adjust the at least one flyweight from the rear face of the balance wheel.

5. A system according to claim 1, wherein a diameter of the rod of the at least one flyweight is at least equal to the width of the housing.

6. A system according to claim 1, wherein the at least one arm, the rim, and the hub form a monobloc element.

7. A timepiece movement comprising the balance wheel-spring system according to claim 1.

8. A timepiece comprising the movement according to claim 7.

* * * * *